US007954973B1

(12) United States Patent
Holland et al.

(10) Patent No.: US 7,954,973 B1
(45) Date of Patent: Jun. 7, 2011

(54) STAIR LIGHTING SYSTEM, AND METHOD FOR ITS IMPLEMENTATION

(75) Inventors: Scott D. Holland, North East, MD (US); Joseph F. Witt, Quarryville, PA (US)

(73) Assignees: Stairlighting System, LLC, North East, MD (US); Ronald Cohen, Broomall, PA (US); Kathryn M. Hetzer, Kirkwood, PA (US); Scott D. Holland, North East, MD (US); Joseph F. Witt, Kirkwood, PA (US)

( * ) Notice: Subject to any disclaimer, the term of this patent is extended or adjusted under 35 U.S.C. 154(b) by 277 days.

(21) Appl. No.: 12/074,702

(22) Filed: Mar. 5, 2008

Related U.S. Application Data

(60) Provisional application No. 60/906,197, filed on Mar. 10, 2007.

(51) Int. Cl.
*F21S 8/00* (2006.01)

(52) U.S. Cl. ..... 362/146; 362/20

(58) Field of Classification Search ..... 362/145, 362/146, 20, 800, 276, 394, 411, 295, 240, 362/576, 249.02
See application file for complete search history.

(56) References Cited

U.S. PATENT DOCUMENTS

| | | | | | |
|---|---|---|---|---|---|
| 3,740,541 | A * | 6/1973 | Conradt | 362/146 |
| 3,885,144 | A * | 5/1975 | Lewis et al. | 362/632 |
| 4,394,714 | A | 7/1983 | Rote | |
| 4,425,601 | A * | 1/1984 | Donahue | 362/146 |
| 4,612,606 | A | 9/1986 | Roberts | |
| 4,625,266 | A | 11/1986 | Winter | |
| 5,222,799 | A | 6/1993 | Sears et al. | |
| 5,430,627 | A | 7/1995 | Nagano | |
| 5,626,094 | A * | 5/1997 | Jeffery et al. | 116/205 |
| 5,749,643 | A | 5/1998 | Porter et al. | |
| 5,785,414 | A | 7/1998 | Baker et al. | |
| 5,810,468 | A * | 9/1998 | Shimada | 362/146 |
| 5,918,962 | A * | 7/1999 | Nagano | 362/146 |
| 6,045,232 | A * | 4/2000 | Buckmaster | 362/20 |
| 6,213,622 | B1 * | 4/2001 | Shimada et al. | 362/146 |
| 6,447,136 | B1 | 9/2002 | Liu et al. | |
| 6,582,103 | B1 | 6/2003 | Popovich et al. | |
| 6,606,827 | B1 | 8/2003 | Hoffmann | |
| 6,685,332 | B1 * | 2/2004 | Clark | 362/146 |
| 2001/0036072 | A1 | 11/2001 | Baker | |
| 2003/0189823 | A1 | 10/2003 | George et al. | |
| 2004/0105264 | A1 * | 6/2004 | Spero | 362/276 |
| 2005/0270774 | A1 | 12/2005 | Pan | |

* cited by examiner

*Primary Examiner* — Bao Q Truong
(74) *Attorney, Agent, or Firm* — Jeffrey R. Ramberg

(57) ABSTRACT

A stair lighting system that features: means for sending electrical power from one end to the other end of a stair case down a main line, means for distributing electrical power from the main line to each individual step or tread, and an electrical load in the form of a light source, preferably featuring a light emitting diode (LED), and means for controlling a supply of electrical power to the light source.

17 Claims, 8 Drawing Sheets

STAIR LIGHTING SYSTEM, AND METHOD FOR ITS IMPLEMENTATION

CROSS-REFERENCE TO RELATED APPLICATIONS

This patent document claims the benefit of commonly owned U.S. Provisional Patent Application No. 60/906,197, filed on Mar. 10, 2007, in the names of Scott D. Holland et al. and entitled "Stair lighting system, and method for its implementation."

BACKGROUND OF THE INVENTION

1. Field of the Invention

The present invention relates to artificial, i.e., non-natural, lighting systems, and more specifically to lighting systems designed to illuminate very specific areas, for example, the steps or treads of a staircase.

2. Discussion of Related Art

The issue of illuminating a set of stairs or steps, particularly in the context of private homes, commercial buildings and boats, could stand improvement. In the household context in particular, the usual approach has been to illuminate the general area of the steps, or perhaps even just the room in which the steps are located, with one or more lights powered by 110-120 volts alternating current (VAC). This approach is not fully satisfactory, for a number of reasons.

The supply of household current, while generally good and reliable, is not 100% reliable, and can be interrupted for several reasons, including severe storms in the vicinity, or the need for the utility company to perform repairs or maintenance on nearby electrical wires. Thus, attempting to navigate stairs, at night in a household without power can be tricky and dangerous, and not everyone has a flashlight available, or would have a free hand available to hold a flashlight.

Furthermore, it may be inconvenient or inappropriate to turn on an area or room light at night simply to illuminate the stairs. For example, persons who might be asleep but with the bedroom door open or otherwise located close to the staircase might be awakened by the general lights from the hallway or from another room seeping into their bedroom or otherwise shining on them. Further, in certain settings such as theaters, it is inappropriate and impractical to turn the house lights on to illuminate stairs, and yet for safety reasons, such stairs need to be illuminated in the otherwise darkened room.

In the theater setting, stairs have been illuminated with lights strips or light bars placed along the nose or very edge of the step, where the tread meets the riser. However, such systems either will not work with thick carpeting such as might be present in a home setting, or would end up looking ugly or out-of-place.

On the other hand, some stair lighting systems require that the stairs be carpeted in order to hide the wires conveying electrical power from the power supply to the lighting means behind the carpeting. It would be desirable to have a lighting system that could be used on carpeted or non-carpeted stairs.

Further, some stair lighting systems provide for attaching the lighting means to the junction of the tread and riser by means of a wood screw. As not all steps are made of wood, it would be desirable to have a lighting system that did not require wooden stairs.

In the marine context, it might be dangerous to have 120 VAC lighting systems (shock hazard). Low voltage incandescent systems (12 VDC, for example) might draw too much current, and quickly drain batteries, if this power is supplied by batteries.

Still further, there are fishing regulations against the use of powerful lights on boats, because if they were to be shone on the water, they would attract fish, and would give the fisherman an unfair advantage.

For all of these reasons, there is a need to improve the issue of illuminating stairs or steps.

OBJECTS AND EMBODIMENTS OF THE INVENTION

Thus, in view of the present state of stair illumination systems, it is an object of the present invention to provide a staircase illumination system that concentrates its lighting on the steps of a staircase, and not so much on surrounding structures or illuminating space of the room in which the staircase lies.

It is an object of the present invention to be able to illuminate spiral as well as standard or straight staircases.

A staircase illumination system that can function even when normal household power has been interrupted is an embodiment of the present invention.

A staircase illumination system that can provide emergency illumination for at least one hour during interruptions in the normal household power (and preferably for at least 12 hours on a fully charged set of batteries) is an embodiment of the present invention.

It is an object of the present invention to provide a staircase illumination system that draws very little current, and/or uses very little power.

A staircase illumination system that the average homeowner can install himself or herself is an embodiment of the invention.

A staircase illumination system that turns itself on and off as needed as indicated by the amount of ambient lighting present is an embodiment of the invention.

SUMMARY OF THE INVENTION

In accordance with the present invention, a staircase illumination system is provided, and which can be used on, or adapted for, both spiral staircases as well as regular, straight staircases. The system features a control box having inputs and outputs for receiving and providing electrical energy, a light that can be located or positioned to illuminate substantially each step or tread of the staircase, means for distributing the provided electrical energy along the stair case, and means for further distributing the electrical energy to each of the lights. The lights preferably are lights that draw little current such as light-emitting diodes ("LEDs"), the LED lights attaching under or near the tread or step of the stair, and the lights illuminating at least the stepping area. In one embodiment, the control box incorporates a photo cell that automatically turns the system on and off in response to the level of ambient light available to the photo cell. The photo cell optionally can be bypassed so that the system can respond to manual control. This is provided in the form of a three-position slide switch, the positions being "ON", "OFF" and "AUTO" (photocell-controlled). In another embodiment, if there is a power failure in the electrical input, the system may also feature a battery back-up that has sufficient energy stored for a minimum of one hour of operation. It has been found that a battery pack of "AA" sized rechargeable batteries can provide at least 12 hours of lighting when fully charged. The system, or at least certain components of the system such as the control box and the LEDs, can be made water resistant, for example, with rubber gaskets, so that the system may be used outdoors.

BRIEF DESCRIPTION OF THE DRAWINGS

In the following figures, which are not necessarily to scale, like numbers identify like parts.

DETAILED DESCRIPTION OF THE INVENTION

Figures 1, 1A:
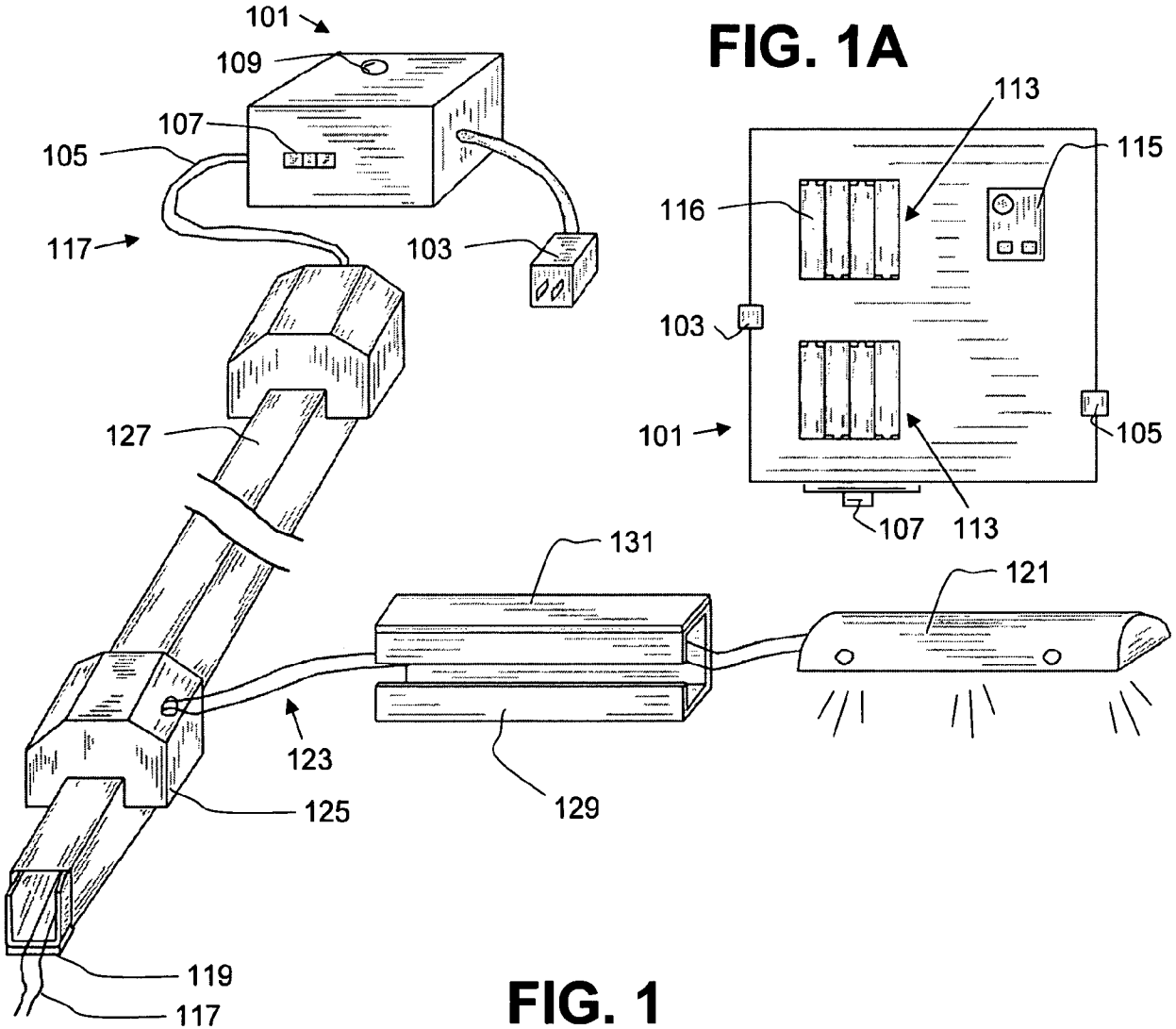
FIG. 1 is a perspective view of the major components of the instant stair lighting invention.
FIG. 1A is a top view of the interior contents of the control box.

A staircase illumination system is provided, and which can be used on both spiral as well as on regular staircases. Moreover, a single power source can illuminate more than one flight of stairs, for example, a stairway/stairwell that connects multiple floors in a commercial or public building. The system features a control box that controls the supply of electrical energy, lights that attach under the tread of the step, the lights illuminating the stepping area, and means, e.g., electrical conductors or "wires" for distributing the electrical energy from the control box to the lights. The control box potentially performs a number of functions: it may need to provide a means for switching between "manual" (ON/OFF) and "automatic" control of the lighting system; it may need to convert electrical energy from one form to another (AC to DC, for example); it may need to change the voltage supplied to it for use with relatively low voltage lights, such as lights that run on DC power; and it may need to provide an emergency or back-up supply of electrical power in case of failure or other interruption of the usual supply of power.

The 9-12 volt DC power for the lights is regulated with a three-position switch. The switch can be a toggle or rocker switch, but preferably is a slide switch. In addition to the normal or expected "on" and "off" positions, the switch also features a position whereby operation is "automatic". That is, the operation is controlled by a photocell, turning the lights on when the photocell senses insufficient ambient light (as measured by light falling on the photocell), and turning the lights off when the photocell senses sufficient ambient light.

In one embodiment, the power supply is housed in the control box. In an alternate embodiment, the power supply is not housed within the control box, but instead is provided separately. In particular, a "standard, off-the-shelf" power supply is one that converts 120 volts AC to low voltage direct current (DC), for example, 12 volts DC. Thus, the control box can be supplied with 12 volts, and it puts out or supplies the light assembly circuits with 9-12 volts, all DC current.

The control box may also feature a back-up power supply, which can take the form of batteries. For example, 8 batteries of the "AA" size are sufficient to provide back-up power to the instant step lighting system for at least six to twelve hours in the absence of 120 volt AC house current. Because of the danger of attempting to recharge non-rechargeable batteries such as alkaline batteries, the batteries need to be of the rechargeable variety. In this case, when house current is available, the batteries are kept charged by means of a 12-volt DC trickle charger. The charger may also be housed in the control box. The control box may also feature a means for switching from house current to the back-up battery power when the control box senses an interruption in the house current.

The light for the step or tread are provided in the form of a light emitting diode (LED). In one embodiment, three LEDs may be mounted in a housing such as a two-piece molded housing made of plastic such as high impact polystyrene (HIPS). The type of plastic, however, is not thought to be particularly critical, and other polystyrenes or other high-impact plastics or even other plastics having similar properties or reasonably high strength should function in an acceptable mariner. One LED may be arranged to shine in a generally downward direction, and the other two may be arranged or oriented to shine at an angle such as at a 45 degree angle or thereabouts and to the left or to the right of the vertical, thereby illuminating the left and right sides of the step or tread. The housing itself may feature an angle somewhat off or away from a right angle. For example, at least one side of the housing may be angled at about a 15 degree angle so that the light does not shine down vertically, but rather at an angle about 15 degrees from the vertical, out in a forward direction as viewed from the perspective of a person descending the staircase. Preferably, both sides of the housing are so angled, so that the housing may be oriented on the step or riser, and the wires can extend out of the housing to the left or to the right, as desired or as needed. The housing may be provided with a transparent or translucent diffuser plate, lens or cover for diffusing or spreading out the light. In another embodiment, no such diffuser plate/lens/cover is provided between the LED lamps and the surfaces to be illuminated.

The one or more LEDs are attached to a small circuit board featuring a dropping resistor. The LEDs are arranged in the circuit such that each sees a voltage of about 2 to 5.5 volts, and preferably around 4.5 volts. Many LEDs are designed to operate in this voltage range. In the embodiment featuring multiple LEDs, the LEDs are electrically connected in parallel with one another, and the dropping resistor is placed in series with the LED collection. Preferably, the small circuit board and voltage divider are contained within the LED housing.

The LED housing may be mounted under the tread or step using fasteners such as screws or double-sided tape or other adhesive. Alternatively, the LED housing may be mounted on the riser portion. The LED housing and mini circuit board is attached to a pair of 22 or 24 gauge wires about 22 inches long that terminates in a molded plastic plug. A 15-inch length of double-sided tape can be used to fix or mount the pair of wires to the step or tread in an inconspicuous and preferably unobtrusive place. In one embodiment, the pair of electrical wires is mounted inside of a polystyrene plastic track, and this "small-wire track" is adhered with double-sided adhesive tape to the bottom surface of the "lip" of the tread. In an alternate embodiment, the plastic small-wire track is mounted to the step or tread with fasteners such as screws.

The power supply supplies 9-12 volt DC electrical power to a length of 10-gauge electrical conductor. The 10-gauge electrical conductor fits in a molded plastic housing called a "large-wire channel" that is sufficient to traverse the length of the staircase, or in the case of a spiral staircase, traverse the length of the center support, e.g., a pole. The large wire channel may also be attached to the staircase using adhesives such as double-sided tape, or with fasteners such as screws. When the surface to which the large channel or small track is to be mounted is carpeted, the installer may prefer to use fasteners such as screws instead of adhesive. Conversely, when the mounting surface is harder, flatter and/or smoother such as wood, metal, ceramic or plastic, the installer may prefer to use an adhesive attachment protocol.

An electrical connector or tap distributes the electrical power from the 10-gauge electrical conductor in the channel to the set of 22-24 gauge wires. The connector features a main body portion that attaches to the channel housing the electrical cord in the form of the 10-gauge electrical conductor pair. The connector also features a pair of knife edges, with each knife edge being electrically connected to one of the pair of 22/24 gauge electrical wires. The knife edges are capable of piercing the plastic insulation covering the 10-gauge electrical conductors, thereby making electrical contact with the 10-gauge electrical conductors and thus with the supply of electrical energy.

Between each plug/connector is a short length of extruded plastic concealment cover that latches onto the channel (thus, a "large-wire channel cover"), thereby concealing the 10-gauge electrical conductors housed in the channel.

In one embodiment, the plastic tracks, channels and covers are paintable so that colors other than the stock plastic colors may be provided for. Specifically, the customer or end-user may paint these plastic components as desired.

The 9-12 VDC electrical energy is supplied from the power supply to the 10 gauge electrical conductors in the large-wire channel by means of a power cord. The power cord consists of molded, two-conductor 22/24 gauge insulated wire with one end terminating in the control box and the other end terminating in a plug designed or arranged to connect and make electrical contact with a connector unit located at one end of the channel.

The invention will now be described in more detail with reference to the drawings.

Example 1

Referring to FIG. 1, integrated control box 101 features an electrical power input 103 and an electrical power output 105, three-position switch 107 and photocell 109. FIG. 1A schematically shows the contents of integrated control box 101 and specifically shows back-up power supply 111 in the form of battery pack 113 and trickle charger 115 to keep the batteries 116 charged during normal operation. "Integrated" means that this control box contains circuitry to convert 110 volt AC "house" current to low voltage DC current.

Referring to FIG. 1 again, electrical power coming out of the integrated control box is conveyed down the staircase by means of a pair of electrical conductors 117. Here, the conductors are 10-gauge insulated wire. The insulated wire is placed within a polystyrene plastic channel (not shown). The channel extends substantially the entire length of the staircase, about 15 to 20 feet, and can be adhered to the staircase by means of double-sided adhesive tape 119. Every step features a trio of LED lights mounted in a housing 121. Electrical power is conveyed or distributed from the pair of 10-gauge insulated electrical conductors to the LEDs by another pair of electrical conductors, specifically, 22-24 gauge insulated wires 123. At one end, the pair of 22/24 gauge wires terminates in a connector 125. At the other end, the wires terminate in the LED housing 121, and specifically in an electrical circuit that first drops the voltage to a range suitable for the LEDs, and then drops this remaining voltage evenly across each of the three LEDs. Between the connectors, the channel is covered with a plastic cover 127 arranged to snap in place by mechanically locking with the plastic channel. The connector is also designed to snap or mechanically lock to the plastic channel. Between the connector and the LED housing, the pair of insulated wires 123 is housed in a flexible plastic conduit or "small wire track" 129 which may be adhered to the bottom of a step or tread by means of double-sided adhesive tape 131. This conduit can have a cross-section that is substantially "C"-shaped, and is sufficiently flexible that the two ends of the "C" may be temporarily pried apart to insert the 22/24 gauge wires therein.

Figure 2:
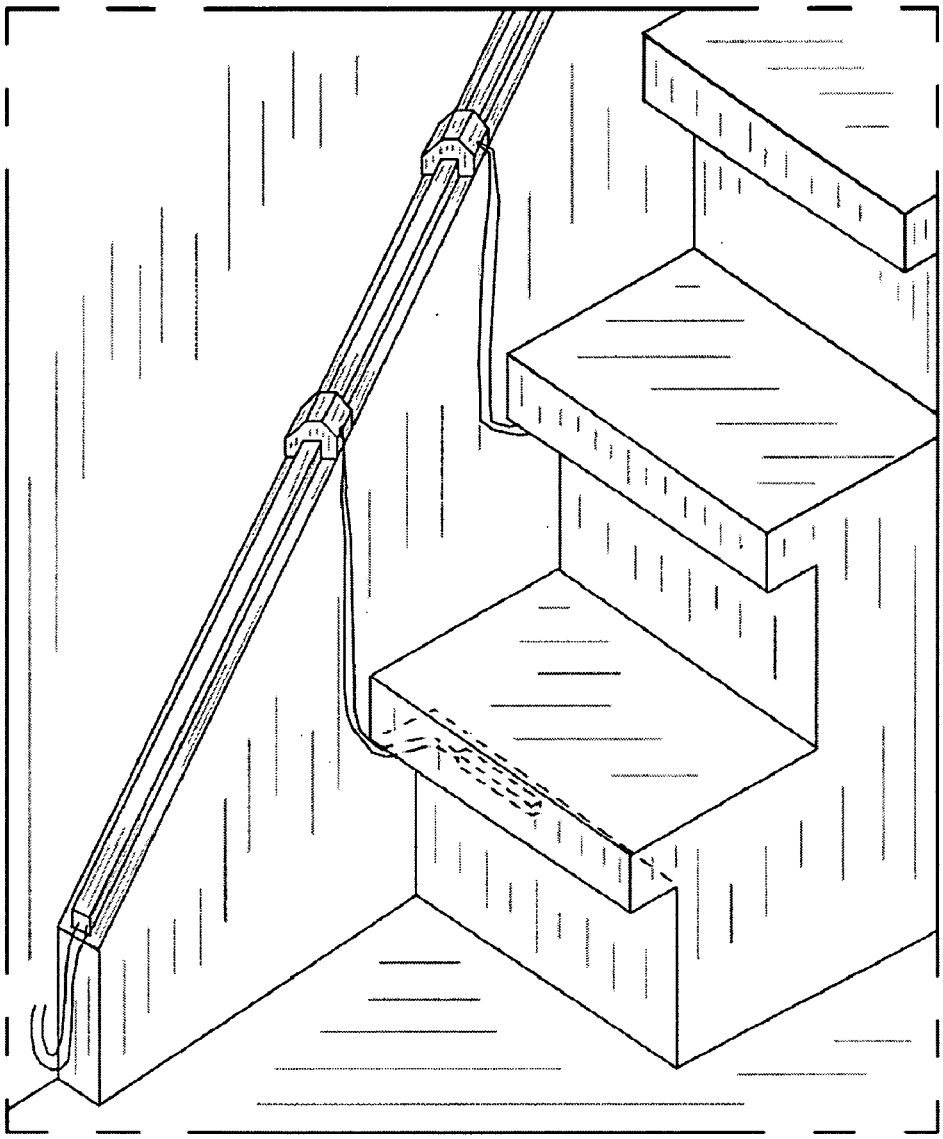
FIG. 2 is a perspective view looking from above onto the track, power cord, connector and 22/24 gauge wire components of the instant stair lighting system in a deployed condition.
Figure 3:
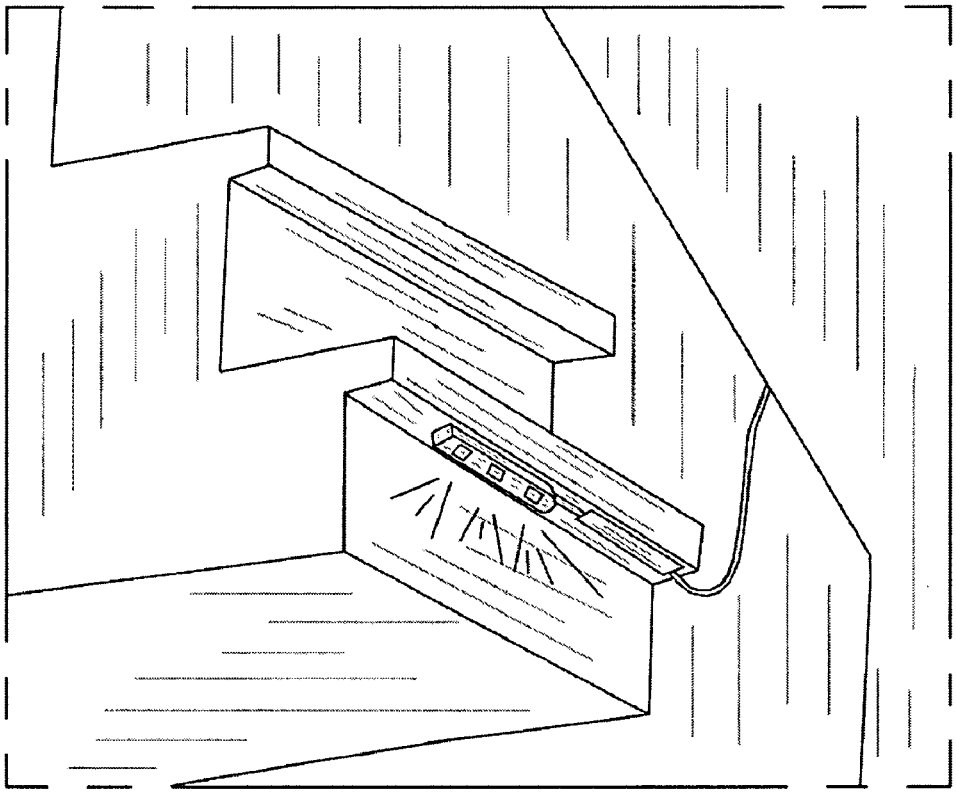
FIG. 3 is a perspective view looking from below a stair tread, showing the LED housing in a deployed condition.

FIGS. 2 and 3 show top and bottom perspective views, respectively, of the step lighting system as it might be deployed in a typical environment in a home or in a vehicle such as a boat.

Figure 4A:
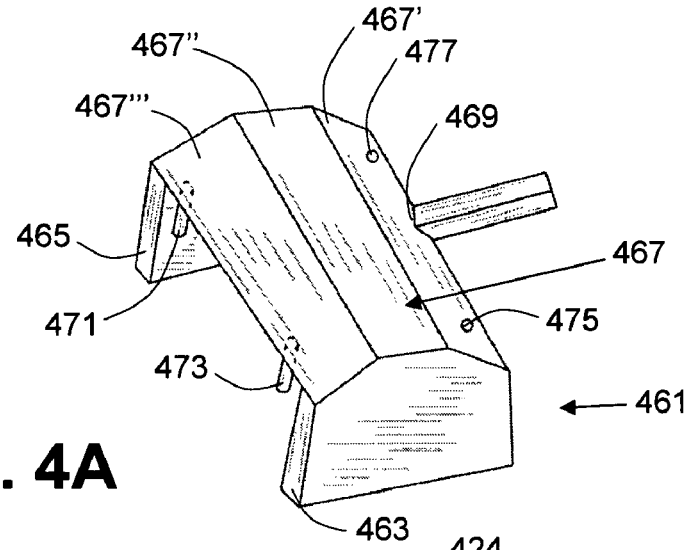
FIGS. 4A-4C are exploded, perspective views of the connector.
Figure 4B:
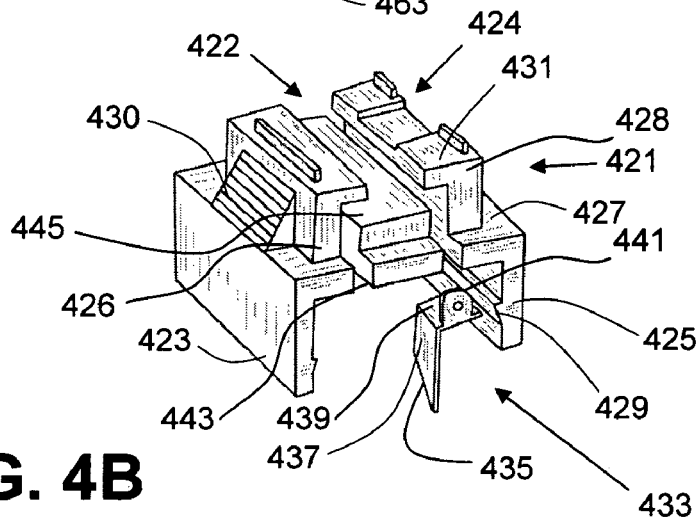
Figure 4C:
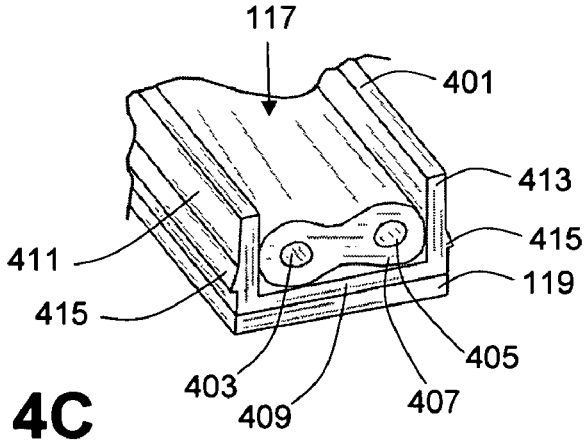

Referring now to FIGS. 4A through 4C, the constituent parts and operation of the connector will now be explained. Again, the purpose of the connector is to distribute electrical power from any desired point along the path of the 10-gauge electrical conductors to the LED housings on the stair riser or underside of the tread, by permitting the pair of 22-24 gauge wires to "tap into" the 10-gauge electrical conductors at any desired location. FIG. 4C shows a perspective view section of the 10-gauge insulated electrical conductors in the plastic channel 401. The 10-gauge electrical conductors are seen to consist of metal conductors 403 and 405 housed in a common piece of molded insulation 407. The channel 401 features a bottom wall 409 and two side walls 411 and 413. Each wall features a tab 415.

FIG. 4B is a perspective view of the main body portion 421 of the connector. It features side walls 423 and 425 and ceiling 427. Each side wall features a ridge 429. The ceiling 427 supports additional structure 431 for supporting the knife 433, for housing the electrical wires 123 and for engaging connector lid 461. Knife 433 features cutting edge 435, blade 437, mounting pad 439 and electrical connection tab 441. The figure furthermore shows that knife 433 slides into slot 443 such that mounting pad 439 rests in contact with mounting surface 445.

Connector lid 461, shown in perspective view in FIG. 4A, features front wall 463, rear wall 465, and cover 467 in three segments, 467', 467" and 476'". Segment 467' contains a recess 469 to accommodate the exit of the 22/24 gauge pair of wires. Connector lid 461 also features four mounting pins 471, 473, 475 and 477, whose function will be described shortly.

Each of the pair of 22/24 gauge wires is attached to one of the pair of metal knife edges or blades 433, specifically at connection tab 441. The connection may be made by the usual connection means, including soldering, solderless connectors and spring-loaded mechanical attachment. Each of the 22/24 gauge wires extends from connection tab 441 through channel 422 and out recessed exit region 424. The blades are mounted in the connector in a fixed and spaced-apart relationship. More specifically, each blade 437 is so arranged and oriented such that when the main body portion 421 of the connector 125 is snapped into position on the plastic channel 409, the edge 435 of blade 437 will penetrate or cut into one of the pair of 10-gauge electrical conductors 117 in the channel, cutting through the insulation 407, thereby making electrical contact with conductor 403 or 405 and thus distributing electrical power from the 10-gauge electrical conductors into the 22/24 gauge wires for distribution to the LEDs. Ridges 429 on the main body portion engage tabs 415 on the plastic channel 401, thereby fixing and holding these two pieces together as a unit.

Connector lid 461 is then placed over main body portion 421, aligned, and snapped into position. Alignment pins 473 and 475 engage surfaces 426 and 428, and alignment pins 471 and 477 engage the opposing surfaces on the back of main body portion (not shown). Lip (not shown) on the underside of panel 467''' engages steps 430. With corresponding lip on the underside of panel 467' engaging steps on the right side of main body portion (not shown), the connector lid 461 is thereby mechanically attached to main body portion 421.

Figure 5A:
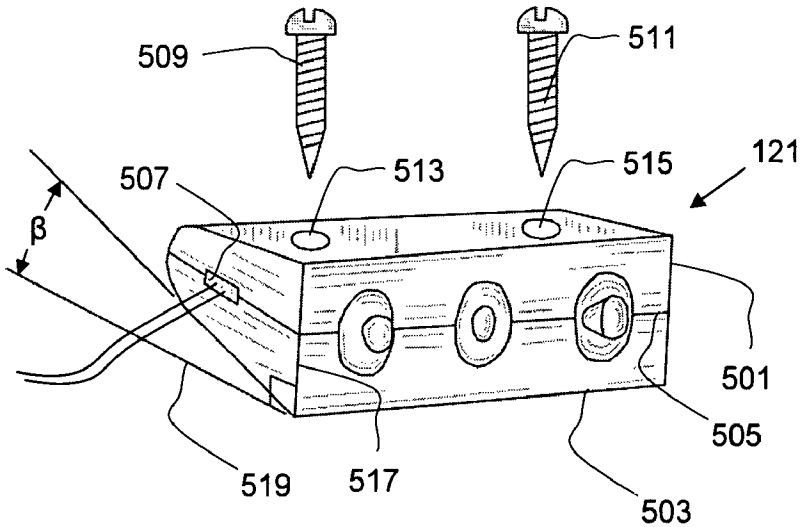
FIGS. 5A and 5B are perspective and orthogonal sectional views of the LED housing.
Figure 5B:
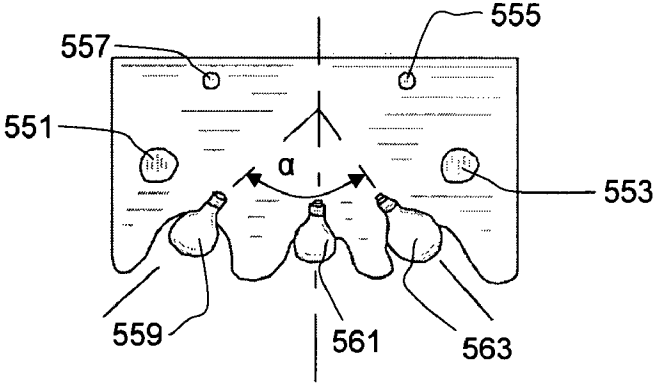
Figure 6:
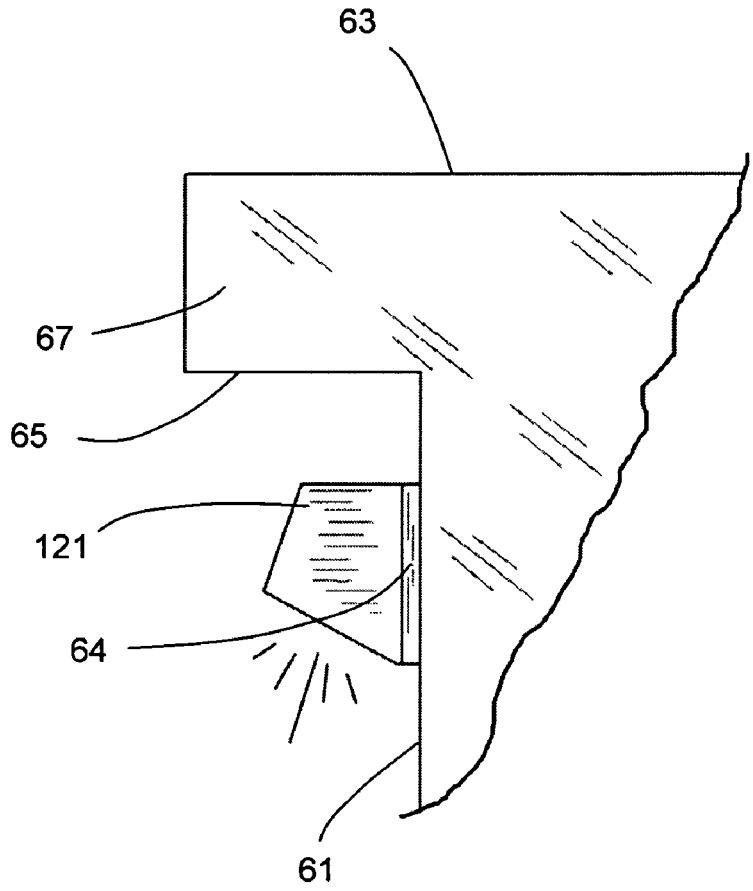
FIG. 6 is a side view of a staircase showing an arrangement for mounting the LED housing to the riser.

FIGS. 5A and 5B show various aspects of the LED housing 121. FIG. 5A is a perspective view. It shows that the housing may be made in two parts 501 and 503, with a split 505 going longitudinally down the housing. The figure also shows the 22/24 gauge wires going into the housing at an entrance region 507. It furthermore shows means for mounting the housing to the staircase, more specifically, to the riser of the staircase. Here, the mounting means is by way of screws (509, 511) that fit through holes (513, 515) that extend all the way through the housing. Alternatively, the housing could be mounted by means of adhesive such as double-sided tape. (Alternatively, the housing could be mounted to the underside of the lip of the step, but if done with screws or nails, the housing would have to feature a flange through which the mounting holes would be provided.) This view also shows the angle "beta", here, about 15 degrees. Edge 517 is orthogonal to leg 519 of angle beta. Among the purposes of this angle is to help direct the light more toward the edge of the step instead of directly beneath the LED housing. In other words, instead of directing the light straight down, the light is directed about 15 degrees forward. FIG. 6 assists in seeing this aspect of the invention.

FIG. 5B in particular is an orthoscopic view of one half of the LED housing. It shows mounting holes (551, 553), alignment pins (555, 557), and three LEDs (559, 561 and 563). The angle "alpha" here is about 94 degrees. Thus, the LEDs on the ends help direct their light at an angle of about 47 degrees from that of the center LED. This helps to illuminate more of the width of the step, i.e., the left and right regions of the step. FIG. 3 helps to more fully illustrate this aspect of the invention.

FIG. 6 shows an embodiment for mounting and attaching the LED housing to the step or riser, respectively. The figure is a side view of a staircase and specifically of the region where the riser 61 meets the step or tread 63. LED housing 121 attaches to riser portion 61 by means of double sided tape 64. In an alternate embodiment (not shown), the LED housing is attached to the underside 65 of lip 67. The attachment is by means of screws extending into lip 67 by way of flanged portions extending to each side of LED housing 121. Note that the LED housing of this alternate design is not interchangeable with that of FIG. 6 because the light would not be directed onto the step beneath the mounting location.

Example 2

Figure 7:
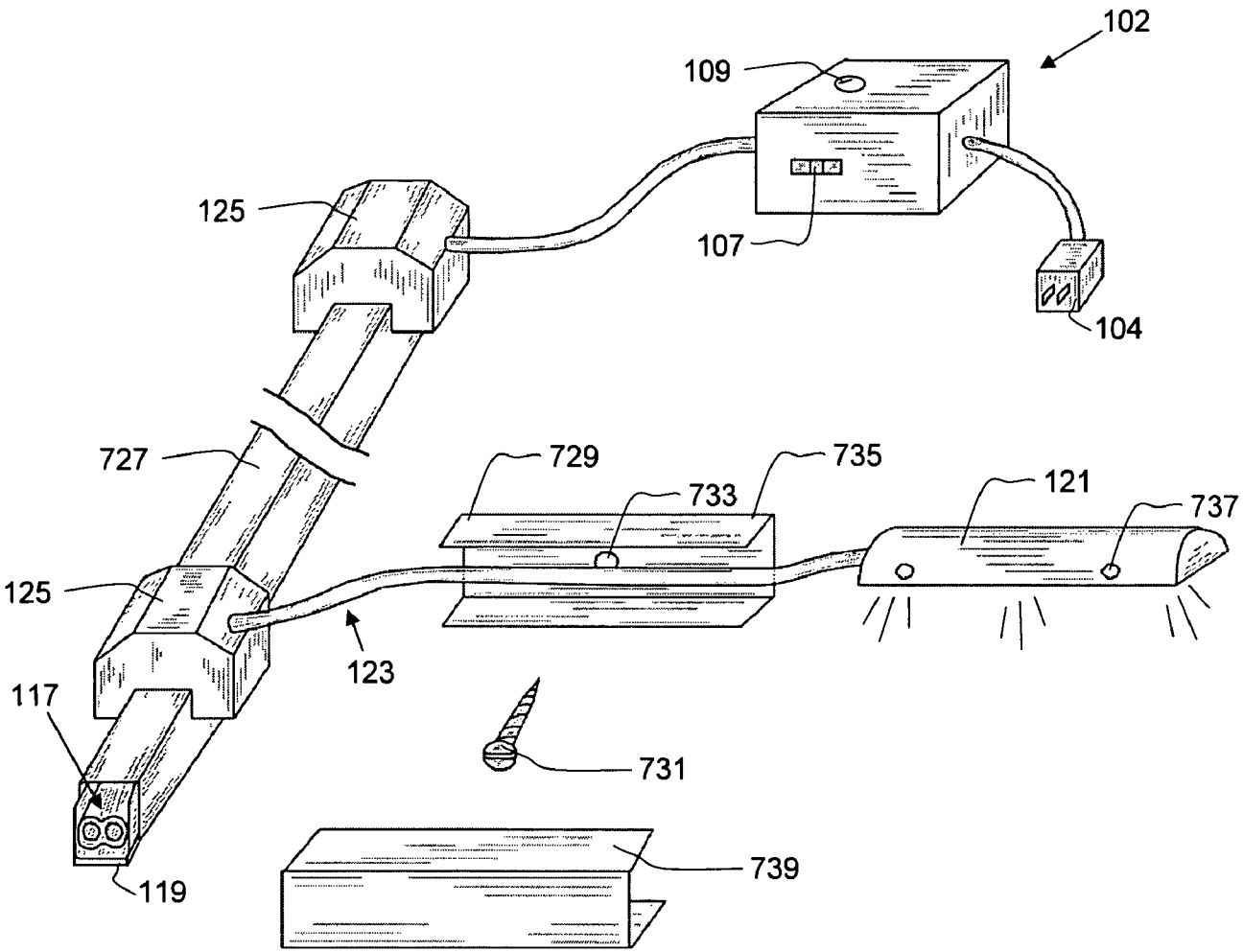
FIG. 7 shows a different embodiment of the invention in accordance with Example 2.

This Example shows how to install a residential stair lighting system on a fifteen-step stairway. This embodiment furthermore is slightly different from that described in Example 1, and is illustrated with reference to FIG. 7. This embodiment furthermore illustrates the invention in modular or "kit" form and particularly for installation on carpeted stairs.

The stair lighting kit consists of a power supply 104, a control box 102, a power cord 717, a 15-foot length of 10-gauge two-conductor insulated wire 117, four 4-foot sections of plastic channel (not shown), four 4-foot sections of plastic cover material 727, fifteen sections of additional plastic channel material 729, fifteen LED light assemblies 121, fifty ¾ inch long screws, thirty 1⅛ inch long screws, and a 50-foot roll of ⅜ inch wide double sided tape.

Step 1: The installer cleans the back of the four-foot sections of plastic channel material with swabs soaked in alcohol such as rubbing alcohol.

Step 2: Using alcohol-soaked swabs, the installer cleans the area along the side of the step where he will be attaching the channels. This area should dry thoroughly.

Step 3: The installer applies one side of the double-sided adhesive tape to enough pieces of the four foot-long sections of plastic channel material to go from the top to the bottom of the stairs. The installer leaves the protective backing attached to the other side of the adhesive tape.

Step 4: The installer now removes the backing layer and adheres the plastic channel to the cleaned area along the side of the stair case, starting adjacent to the front of the tread of the top step. Moving down, the installer butts each section of channel material up to the preceding piece, making one long channel.

Step 5: The last piece of plastic channel material should extend about 2 inches past the last stair.

Step 6: The installer measures, cuts and attaches this last piece of plastic channel material.

Step 7: Starting at the top of the stairs, the installer places the 10-gauge insulated wire into the channel continuing down to the bottom of the channel, and being sure to lay the wire flat with no twists in it.

Step 8: The installer cuts the end of the 10-gauge wire flush with the end of the plastic channel.

Step 9: If the channel covers and the LED assemblies are to be painted, this should be done now, with the installer exercising care not to paint over the LED lights or the metal barbs protruding from the plugs.

The installer measures the width of the stair. For 34-inch wide stairs, the plastic channels for the 22/24 gauge wires of the LED assemblies are cut to a length of 15 inches. For every 2 inches of extra width; the channels should be cut one inch longer (and vice-versa) to keep the light assembly located in the center of the stair.

Step 10: Using the ¾ inch screws 731 and the periodically spaced-apart holes 733 provided in the plastic channel material 735, the installer fastens a plastic channel section to the riser portion of the stair, where the riser meets the underside of the step. One screw is installed at each end of the track, and one or two screws are spaced equally in the middle.

Step 11: The installer installs a LED light assembly 121 at the end of each section of small-wire track, in the center of each stair, using the 1⅛ inch screws (not shown) inserted into holes 737. The LED light assembly is connected to a length of 22/24 gauge two-conductor insulated wire which terminates in a plug or connector.

Step 12: The installer installs the connector onto the plastic channel by positioning the connector at the nearest location on the channel, and pressing the connector firmly onto the plastic channel until it latches into place.

Step 13: The installer places 22/24 gauge two-conductor wire 123 into the plastic channel attached to the step, and installs the cover 739 over the wire. The installer repeats Steps 10 through 13 for each section of plastic channel.

Step 14: At the bottom of the channel running down the staircase, the installer places the last LED connector assembly one connector length from the bottom of the track. Below this LED connector, the installer attaches the plug assembly for the power cord. The installer runs the power cord to the control box.

Step 15: Starting at the top of the stairs, the installer measures the distance between each LED connector assembly, and cuts a piece of plastic channel cover material to match.

Step 16: The installer snaps each section of plastic cover material over the plastic channel to complete the installation.

The user opens up the control box by removing the four screws on its underside. The user installs 8 AA Rechargeable batteries into the battery trays in the control box. After installing the batteries, the user places the cover back on the box and reinstalls the screws.

The user now places the two bare ends of the power cord into the red and black connectors on the control box. These connectors are the press-insert-and-release type.

The user now installs the round plug on the transformer into the 12V DC side of the control box, and plugs the other end into a 110V AC electrical outlet. On the same side of the control box is a three-position switch: AUTO/ON/OFF. AUTO turns the system on and off automatically based on ambient light conditions. ON has the system remain on all the time. OFF has the system off all of the time.

The user should now turn the system to ON. The stairs should be illuminated. If the lights are flashing, the rechargeable batteries are not fully charged. No action is required; the lights will stop flashing once the batteries are fully charged. If the lights do not light at all, the polarity may be reversed. Disconnect the power, remove the power cord wires from the red and black connectors on the control box, and reverse them. When the power is re-applied to the control box, the lights should come on.

Example 3

Figure 8:
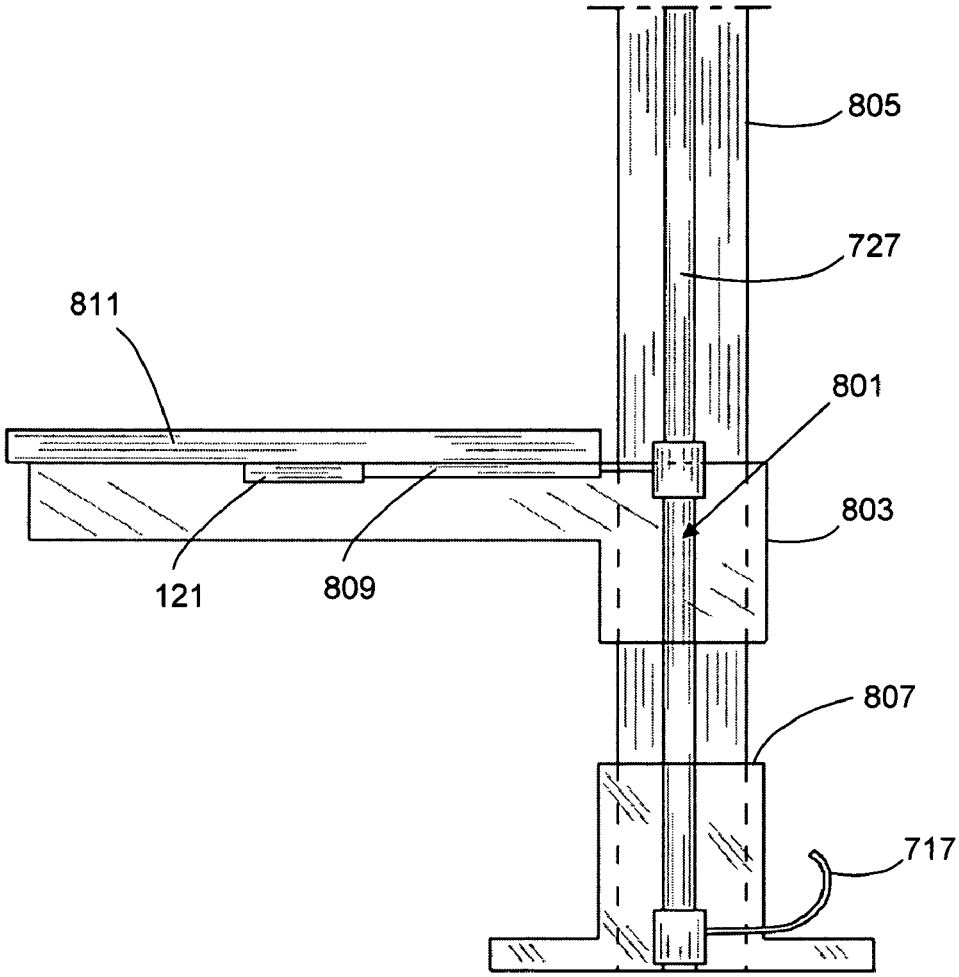
FIG. 8 shows an alternate embodiment of the invention in accordance with Example 3.

This Example shows how to install a residential stair lighting system on a fifteen-step spiral staircase having uncarpeted steps. This embodiment is described with reference to FIG. 8.

The stair lighting kit consists of a power supply 104, a control box 102, a power cord 717, a 15-foot length of 10-gauge two-conductor insulated wire 117, three 4-foot sections of plastic channel (not shown), three 4-foot sections of plastic cover material 727, fifteen sections of plastic small track material 809, fifteen LED light assemblies 121, a 20-foot roll of ¼ inch wide double-sided adhesive tape, and a 20-foot roll of ⅜ inch wide double-sided adhesive tape.

The installation is substantially the same as that for straight staircases described in Example 2, with the following notable exceptions.

In Step 2, the installer applies ¼ inch wide double-sided adhesive tape to the small wire tracks 809. With the slot facing toward the installer, the tape is applied to the top surface.

In Step 4, the installer cuts and adheres each 4-foot plastic channel section so that it ends in the middle 801 of the stair collar 803. The plastic channel is attached to the vertical pole 805 adjacent each stair 811. Since the stairs spiral down the vertical pole, so does the plastic channel material.

In Step 6, the installer cuts and adheres the last piece of plastic channel material so that it is flush with the bottom of the last stair collar 807.

In Step 7, the installer places the large gauge two-conductor insulated wire into the plastic channel starting ¼ inch from the top and ending ¼ inch from the bottom of the channel. The excess wire is cut off using wire cutters.

In Step 9, the small-wire tracks are cut into lengths of 14¼ inches for small spiral stairs, or 16 inch lengths for larger stairs.

In Step 10, the small-wire tracks 809 are installed not with screws, but by removing the protective backing from the double-sided adhesive tape, locating the small-wire track under the front of the step, and pressing firmly.

In Step 11, the LED assemblies are attached to the stairs not with screws, but with ⅜ inch wide double-sided adhesive tape.

In Step 13, instead of placing the 22/24 gauge wire into a plastic channel and affixing a plastic cover over the plastic channel, the installer pushes the 22/24 gauge wire into the small wire track using a wooden tongue depressor.

INDUSTRIAL APPLICABILITY

The stair lighting system of the present invention should find utility in households, businesses large and small, public buildings, railroads, boats/ships and aircraft, and in most any other setting where one has a need to illuminate steps in an efficient and unobtrusive way. The instant stair lighting system can be used on carpeted or non-carpeted stairs; and on wooden or non-wooden stairs.

An artisan of ordinary skill will appreciate that various modifications may be made to the invention herein described without departing from the scope or spirit of the invention as defined in the appended claims.

What is claimed is:

1. A stair lighting system, comprising at least one light source comprising a light emitting diode arranged to be mounted in the approximate center of the width of a stair of a staircase, and arranged to illuminate at least one step or tread in a substantially downward direction, wherein said at least one light source comprises a plurality of lights arranged to illuminate different portions or regions of a single step or tread, and further wherein two of said plurality of lights are aimed about 94 degrees from one another.

2. The stair lighting system of claim 1, further comprising (a) a control box arranged to supply electricity, the control box comprising at least one of (i) a battery back-up, and (ii) on-off regulation of the light source by means of a photocell; and (b) means for conducting said electricity from said control box to said light source.

3. A stair lighting system, comprising at least one light source comprising a light emitting diode arranged to be mounted in the approximate center of the width of a stair of a staircase, and arranged to illuminate at least one step or tread in a substantially downward direction, said stair lighting system provided in the form of a kit of components comprising:

(a) a control box having a low voltage DC output;

(b) an at least 13-foot length of electrical cord comprising at least two electrical conductors embedded in electrical insulation, said conductors being capable of carrying at least 1000 milliamperes of electrical current;

(c) plastic channel material having an overall length of at least about 13 feet;

(d) plastic cover material having an overall length of at least about 13 feet, each of said plastic channel material and said plastic cover material being provided in a plurality of segments;

(e) a plurality of housings comprising LEDs, said housings being sufficient in number such that the LEDs can illuminate substantially every tread or step of said staircase;

(f) means for making electrical contact between said LEDs and said electrical cord, and further wherein each of said means is capable of carrying at least about 100 milliamperes of electrical current;

(g) means for making electrical contact between said output of said control box and said electrical cord; and (h) a supply of fasteners.

4. The stair lighting system of claim 3, further comprising a power supply.

5. The stair lighting system of claim 3, wherein said power supply converts 110-120 volts alternating current to 9-12 volts direct current.

6. The stair lighting system of claim 3, wherein said supply of fasteners comprises at least one of double-sided adhesive tape, screws, nails, tacks, staples, brads and rivets.

7. The stair lighting system of claim 3, wherein said means for making electrical contact between said cord and said LEDs comprises at least two wires, and further comprising a small-wire track for housing said at least two electrical wires.

8. The stair lighting system of claim 3, wherein said second track is provided in a plurality of segments each at least about 13 inches long, and wherein said plurality is sufficient in number for every step or tread illuminated.

9. The stair lighting system of claim 1, wherein at least one of said plurality of lights is arranged to shine at an angle of about 47 degrees to the left or right of center.

10. The stair lighting system of claim 1, wherein at least one of said plurality of lights is arranged to shine forward at an angle of about 15 degrees from the vertical.

11. The stair lighting system of claim 1, wherein said illumination is without a transparent or translucent light diffuser means positioned between said light emitting diode and said portions to be illuminated.

12. A stair lighting system, comprising at least one light source comprising a light emitting diode arranged to illuminate at least a portion of a staircase, the illumination being without a transparent or translucent light diffuser means being positioned between said light emitting diode and the portion to be illuminated, wherein said at least one light source comprises a plurality of lights, and wherein two of said plurality of lights are arranged to shine at an angle of about 94 degrees from one another.

13. The stair lighting system of claim 2, wherein said electricity is conducted from said control box along said staircase by means of at least two larger gauge wires, and distributed from said larger gauge wires to said electrical load by means of at least two smaller gauge wires.

14. The stair lighting system of claim 13, wherein said means for distributing said electricity from said larger gauge wires to said smaller gauge wires comprises a connector.

15. The stair lighting system of claim 14, wherein said connector comprises at least one of (i) a plug-and-socket, and (ii) a pair of electrically conducting knife edges arranged to pierce said insulation, thereby making electrical contact with said electrical conductors.

16. The stair lighting system of claim 2, wherein said control box further comprises a back-up power supply comprising at least one battery.

17. The stair lighting system of claim 16, further comprising a means for automatically switching to said back-up power supply when a primary supply of electrical power is interrupted.

* * * * *